United States Patent [19]

Egashira

[11] Patent Number: 4,860,024

[45] Date of Patent: Aug. 22, 1989

[54] ANTENNA FOR A PORTABLE RADIOTELEPHONE

[75] Inventor: Yoshimi Egashira, Kanagawa, Japan

[73] Assignee: Harada Kogyo Kabushiki Kaisha, Tokyo, Japan

[21] Appl. No.: 242,328

[22] Filed: Sep. 8, 1988

[30] Foreign Application Priority Data

Dec. 28, 1988 [JP] Japan ..... 62-201546[U]

[51] Int. Cl.[4] ..... H01Q 1/24

[52] U.S. Cl. ..... 343/702; 343/900; 343/903

[58] Field of Search ..... 343/702, 900, 903; 455/89, 90, 91, 128, 129, 351

[56] References Cited

U.S. PATENT DOCUMENTS

| | | | |
|---|---|---|---|
| Re. 22,365 | 8/1943 | Gebhard et al. | 343/702 |
| 3,087,117 | 4/1963 | Mitchell | 343/702 |
| 4,121,218 | 10/1978 | Irwin et al. | 343/702 |
| 4,543,581 | 9/1985 | Nemet | 343/702 |

*Primary Examiner*—Rolf Hille
*Assistant Examiner*—Hoanganh Le
*Attorney, Agent, or Firm*—Koda and Androlia

[57] ABSTRACT

An improved transmitting and receiving antenna for a portable radiotelephone with an antenna element which can be accommodated inside of the case of the portable radiotelephone, compensating for the drop in reception sensitivity that occurs when the antenna element is located inside of the case. The rod-shaped antenna element freely insertable into and removable from the case, and electrically connected to an antenna retaining mechanism both when the antenna element is retracted and extended. Thus, the antenna element functions even when it is located inside of the case. Moreover, an auxiliary antenna element is connected to the antenna element when the latter is located inside the case. The inductive reactance component of the auxiliary antenna element compensates for deterioration of the Standing Wave Ratio caused by the increased stray capacity resulting from the antenna element being located of inside the case. As a result, an adequate reception sensitivity can be maintained, and when the portable radiotelephone is not in use, the antenna element is withdrawn into the case so as not to create a nuisance; while incoming calls can still be responded to.

3 Claims, 3 Drawing Sheets

ANTENNA FOR A PORTABLE RADIOTELEPHONE

BACKGROUND OF THE INVENTION

1. Field of the Invention

The present invention relates to a transmitting and receiving antenna for a portable radiotelephone with an antenna element which can be accommodated inside the case of the portable radiotelephone by being freely pushed into, and also withdrawn from, the case. More specifically, the present invention relates to a means of compensating for drops in reception sensitivity that occur when the antenna element is inside the case.

2. Prior Art

As is universally known, telephones are instruments which are used for two-way communication, and portable radiotelephones are also used in this way. In telephones for two-way communication it is absolutely impossible to predict when a call signal will be received from a calling party. Accordingly, in conventional portable radiotelephones, as shown in FIG. 6(*a*), the antenna element 1 is fixed so that it constantly projects outside of the case 2 of the portable radiotelephone, thus insuring that a call signal can always be received. Furthermore, the case 2 has the shape of a transmitter-receiver used in ordinary telephones.

Since the antenna element 1 constantly projects outside of case 2 in conventional antennas constructed as described above, antenna element 1 becomes a nuisance when the radiotelephones is not in use. Accordingly, it is desirable to accommodate the antenna element 1 inside the case 2 when the radiotelephone is not in use.

FIG. 6(*b*) illustrates a radiotelephone which is designed so that the antenna element 1 is simply accommodated inside the case 2 (so that it can be freely pushed into or withdrawn from the case). With such a construction, however, the transmission/reception sensitivity of the antenna element 1 drops conspicuously when the antenna element 1 is inside the case 2. As a result, the intrinsic function of the radiotelephone as a telephone, i. e., "the ability to receive call signals at all times," is reduced by half or more.

SUMMARY OF THE INVENTION

Accordingly, the object of the present invention is to provide an antenna for a portable radiotelephone in which (a) the antenna element can be accommodated inside the case of the radiotelephone so that the antenna element does not create a nuisance when the radiotelephone is not in use, and (b) a prescribed reception sensitivity can be maintained even when the antenna element is inside the case, so that responsiveness to calls from calling parties is possible at all times.

In order to solve the problems and achieve the above-mentioned objects, the present invention employs a rod-shaped transmitting and receiving main antenna element installed so that it can be freely pushed into or withdrawn from the case of a portable radiotelephone. This main antenna element is free to slide, held by an antenna retaining mechanism equipped with a conductive part in a state of electrical continuity with the feeding point of the main antenna element, both when the latter is extended outside the case and when it is retracted inside the case. A matching device, one end of which is connected to the conductive part of the antenna retaining mechanism, is installed inside the case. The other end of this matching device is connected to the transmitter-receiver set of the radiotelephone by a feeder cable or other appropriate connecting means. Furthermore, an auxiliary antenna element is installed which is in a state of electrical continuity with the retracted end of the main antenna element when the latter is retracted inside the case, so that the auxiliary antenna element acts as a unit integral with the main antenna element.

The following effect is achieved by the use of the means described above: Specifically, the feeding point of the main antenna element is in a state of electrical continuity with the conductive part of the antenna retaining mechanism not only when the main antenna element is normally extended outside the case, but also when the main antenna element is retracted inside the case. Accordingly, the basic function of the main antenna element can be maintained even when the main antenna element is inside the case when the radiotelephone is not in use. Furthermore, when the main antenna element is inside the case as described above, the auxiliary antenna element is connected to the main antenna element. Accordingly, deterioration of the SWR (standing wave ratio) caused by increased stray capacity resulting from the main antenna element being inside the case is compensated for by the inductive reactance component of the auxiliary antenna element. As a result, adequate reception sensitivity can be maintained. Thus, when the portable radiotelephone is not in use, the antenna element can be inside the case so that the antenna element does not become a nuisance and at the same time, calls can be responded to at all times.

BRIEF DESCRIPTION OF THE DRAWING

FIGS. 1 through 6 illustrate one embodiment of the present invention, wherein:

FIG. 1 is a perspective view which illustrates the external appearance of the portable radiotelephone antenna;

FIG. 2 is a side view which illustrates the main parts of the antenna assembly;

FIG. 3 is a longitudinal-sectional side view of FIG. 1;

FIGS. 4(*a*) and 4(*b*) are explanatory diagrams which illustrate the operation of the present invention;

FIG. 5 is a graph which illustrates the improvement in SWR characteristics; and FIGS. 6(*a*) and 6(*b*) are oblique views which illustrate different examples of conventional prior art technology.

DETAILED DESCRIPTION OF THE INVENTION

Figure 1:
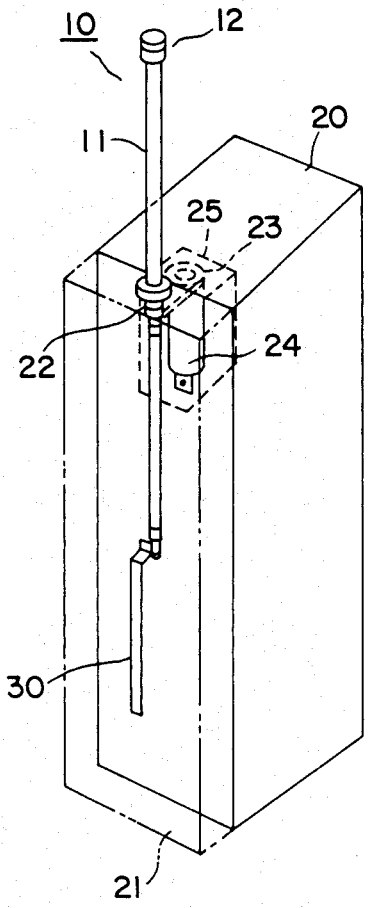
Figure 2:
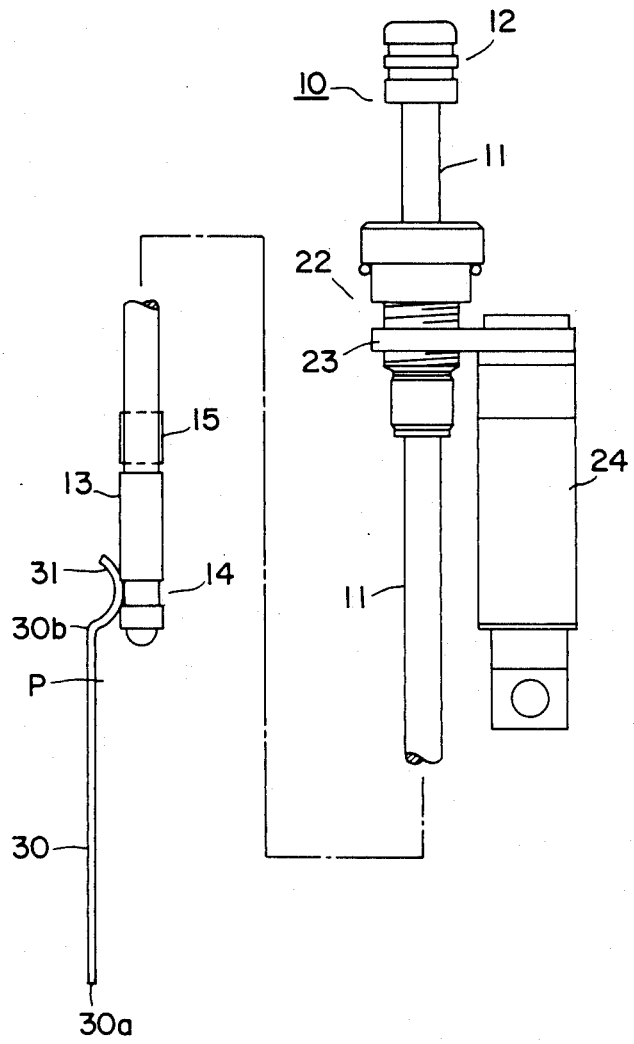

In FIGS. 1 and 2, the rod-shaped transmitting and receiving main antenna element 10 is an ultrashort-wave transmitting and receiving antenna element with a main body including a flexible conductive rod-shaped part 11 whose overall length is set at, for example, $3\lambda/8$ of the wavelength.

A cap 12 which is used both to operate the antenna and to provide protection is fastened to the tip (upper end in the Figures) of the conductive rod-shaped part 11 of the main antenna element 10. Furthermore, a conductive sleeve 13, which is used both to prevent the antenna element from falling out and to connect the auxiliary antenna element to the main antenna element is fastened to the base (lower end in the Figures) of part 11. An annular groove 14 which can engage with one end an the auxiliary antenna element (described below) is formed in one part of the conductive sleeve 13. A retaining part 15 is installed adjacent to the fastening part of the conductive sleeve 13. The retaining part 15 contacts the conductive part of an antenna retaining mechanism (described below) with a prescribed pressure when the main antenna element 10 is extended upward, and thus insures electrical continuity while at the same time maintaining the main antenna element 10 in an extended position. The main antenna element 10 constructed as described above is installed so that it can be freely pushed into or withdrawn from the case 20 of the portable radiotelephone.

The case 20 is shaped roughly in the form of a rectangular parallelepiped. An antenna accommodation space 21 is formed on one side of the case as indicated by the two-dot chain line in FIG. 1. An antenna retaining mechanism 22 is installed in the upper part of this antenna accommodation space 21. This antenna retaining mechanism 22 holds the main antenna element 10 so that the latter is free to slide.

Furthermore, the antenna retaining mechanism 22 is equipped with a conductive part 23 which is in a state of electrical continuity with the feeding point of above-mentioned main antenna element 10, both when the main antenna element 10 is extended outside of the antenna accommodation space 21 and when the main antenna element 10 is retracted inside of the antenna accommodation space 21. This conductive part 23 has a contact (not shown in the Figures) which presses against the circumferential surface of the rod-shaped conductive part 11 of the main antenna element 10, so that electrical continuity is maintained between the conductive part 23 and the rod-shaped conductive part 11.

One end of a matching device 24 is connected to a different part of the conductive part 23. The other end of this matching device 24 is connected to the input and output terminals of the transmitter-receiver set (not shown in the Figures) of the radiotelephone. Furthermore, matching device 24 is adjusted and set so that it insures the impedance matching between the main antenna element 10 and the transmitter-receiver set when the main antenna element 10 is extended above the case of the radiotelephone. This matching device 24 is installed inside a matching device installation space 25 which is located inside the case 20.

An auxiliary antenna element 30 is supported and fixed in place at a point such as P inside the antenna element accommodation space 21, so that the lower end **30*a* of the auxiliary antenna element 30 is maintained in a free state. Furthermore, a bent projection 31 which engages with the annular groove 14 is formed at the upper end 30*b* of the auxiliary antenna element 30. Thus, when the main antenna element 10 is retracted inside of the antenna accommodation space 21 of case 20 the bent projection 31 of the auxiliary antenna element 30 engages with the annular groove 14 of the conductive sleeve 13 installed on the retracted end of the main antenna element 10, so that a state of electrical continuity is established. As a result, the auxiliary antenna element 30 acts as a unit integral with the main antenna element 10**.

Next, the method of use and operation of the antenna embodiment constructed as described above will be explained with the aid of FIGS. 3 and 4.

Figure 3:
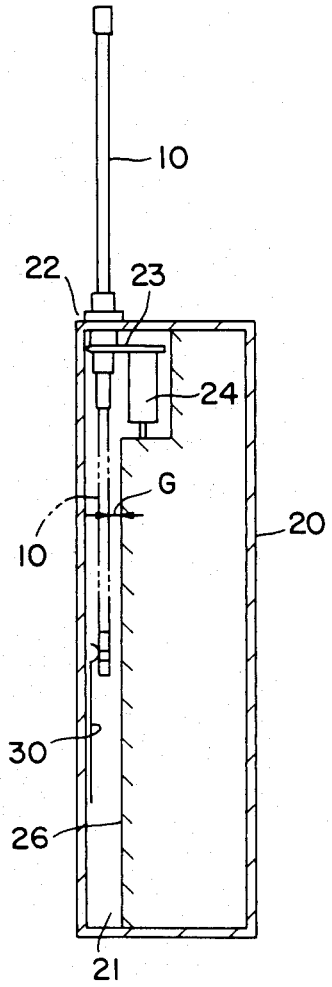
Figure 4A:
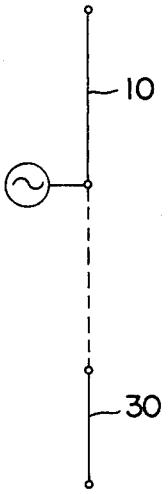
Figure 4B:
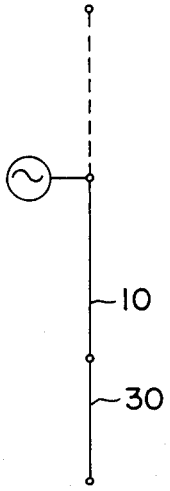

During ordinary use, as is shown in FIG. 3, the power supply of the portable radiotelephone is switched "ON", and the main antenna element 10 is extended outside the antenna accommodation space 21 in the case 20. At this time, the engagement between the annular groove 14 of the conductive sleeve 13 fastened to the base of the main antenna element 10 and the bent projection 31 of the auxiliary antenna element 30 is broken, so that the main antenna element 10 and the auxiliary antenna element 30 are electrically insulated from each other. Furthermore, when the main antenna element 10 is in a fully extended state, the retaining part 15 enters the bottom portion of the antenna retaining mechanism 22. As a result, the main antenna element 10 is maintained in the prescribed extended position, and the feeding point of the main antenna element 10 is electrically connected to one end of the matching device 24 via the conductive part 23. Thus, the main antenna element 10 is set in the state illustrated in FIG. 4(*a*), so that transmission and reception (i.e., communication with another party) can be achieved using ultra-short waves in the range of, typically, 800 to 1000 MHz.

When the portable radiotelephone is not being used, the main antenna element 10 may be retracted inside the antenna accommodation space 21 of the case 20 as indicated by the broken line in FIG. 3. When this is done, the main antenna element 10 is inside of the case 20, so that the main antenna element 10 does not create a nuisance. At this time, the lower end of cap 12 of the main antenna element 10 enters the upper portion of the antenna retaining mechanism 22. Accordingly, the main antenna element 10 is fixed in the prescribed retracted position, and the feeding point of the main antenna element 10 is electrically connected with one end of the matching device 24 via the conductive part 23. At the same time, the annular groove 14 of the conductive sleeve 13 fastened to the lower end of the main antenna element 10 and the bent projection 31 of the auxiliary antenna element 30 engage each other with a prescribed pressure resulting from the elasticity of the auxiliary antenna element 30. Accordingly, the main antenna element 10 and the auxiliary antenna element 30 are electrically connected with each other. In other words, the antenna elements are in the state shown in FIG. 4(*b*), so that the main antenna element 10 and auxiliary antenna element 30 act as an integral unit. As a result, the capacity in the gap G between the main antenna element 10 and the various parts 26 accommodated inside the case 20 (as shown in FIG. 3) is canceled to some extent by the inductive reactance component of the auxiliary antenna element 30 so that the SWR is improved.

Figure 5:
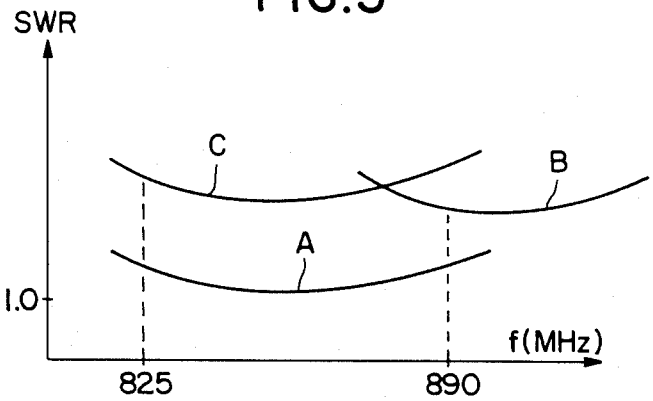
Figure 6A:
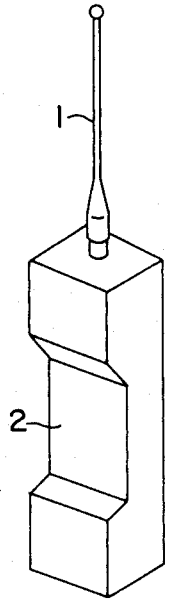
FIG.6a PRIOR ART
Figure 6B:
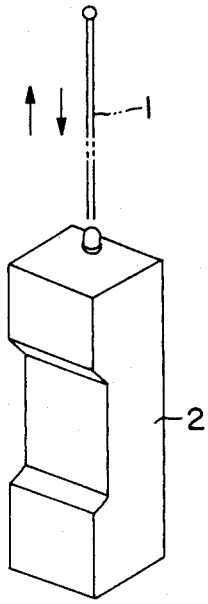
FIG.6b PRIOR ART

FIG. 5 is a graph which illustrates the degree of improvement in the SWR. The ideal SWR characteristic curve (A) applies to a case wherein the main antenna element 10 is extended outside of the radiotelephone case 20. The SWR characteristic curve (B) is observed when no auxiliary antenna element 30 is installed. The SWR characteristic curve (C) is observed when the auxiliary antenna element 30 is installed. In the case of characteristic curve (C), the gain in the transmission band (825 MHz) is improved by approximately 5 to 6 dB, and the gain in the reception band (890 MHz) is improved by approximately 2 to 3 dB, compared to characteristic curve (B). Thus, a prescribed level of reception sensitivity can be maintained even when the main antenna element 10 is inside of the case (20). Accordingly, calls can be responded to at all times.

Thus, in this embodiment of the present invention, transmission and reception at a sufficient sensitivity are possible when the main antenna element 10 is extended outside of the case 20. In addition, as a result of the action of the auxiliary antenna element 30, adequate reception sensitivity (approximately 50% of the normal sensitivity) can be stably maintained even when the main antenna element 10 is retracted inside of the case 20. As a result, when the portable radiotelephone is not in use, calls can still be responded to at all times even though the main antenna element 10 is located inside of the case 20.

Furthermore, the present invention is not limited to the embodiment. It goes without saying that various modifications are possible without departing from the spirit of the present invention.

In the present invention, as described in detail above the rod-shaped transmitting and receiving main antenna element is installed so that it can be freely pushed into or withdrawn from the case of a radiotelephone and is held (so that the main antenna element is free to slide) by the antenna retaining mechanism which is equipped with the conductive part that is in a state of electrical continuity with the feeding point of the main antenna element both when the main antenna element is extended outside of the case and when it is retracted inside of the case. The matching device is installed inside the case, with one end connected to the conductive part of the antenna retaining mechanism, and the other end connected to the transmitter-receiver set of the radiotelephone by an appropriate connecting means. Furthermore, the auxiliary antenna element is installed which is in a state of electrical continuity with the retracted end of the main antenna element when the main antenna element is retracted inside the case, so that the auxiliary antenna element acts as a unit integral with the main antenna element. Accordingly, the present invention provides an antenna for a portable radiotelephone in which the antenna element can be appropriately accommodated inside the case when the radiotelephone is not in use, so that the antenna element does not create a nuisance, and a prescribed reception sensitivity can be maintained even when the antenna element is located inside of the case, so that calls can be responded to at all times.

I claim:

1. An antenna system for a portable radiotelephone comprising:

a transmitting and receiving main antenna element freely insertable into and withdrawable from a case for said radiotelephone;

an antenna retaining mechanism which holds said main antenna element so that said main antenna element is free to slide, said antenna retaining mechanism further being equipped with a conductive part which is in sliding contact with and electrically coupled to said main antenna element both when said main antenna element is extended outside of said case and when said main antenna element is retracted inside said case;

a matching device installed inside said case with one end thereof connected to said conductive part of said antenna retaining mechanism;

a means for connecting the other end of said matching device to a transmitter-receiver set of said radiotelephone; and an auxiliary antenna element provided in said case which engages with and is electrically coupled to a retracted end of said main antenna element when said main antenna element is retracted inside of said case so that said auxiliary antenna element acts as a unit integral with said main antenna element.

2. An antenna system of claim 1 wherein said main antenna element is rod-shaped and also comprises a conductive sleeve with an annular groove on its retracted end.

3. An antenna system of claim 2 wherein said auxiliarly antenna element comprises a bent projection which engages with said annular groove to form said state of electrical continuity with the retracted end of said main antenna element when said main antenna element is retracted inside of said case.

* * * * *